US009486823B2

(12) United States Patent
Andersen et al.

(10) Patent No.: US 9,486,823 B2
(45) Date of Patent: Nov. 8, 2016

(54) OFF-EAR DETECTOR FOR PERSONAL LISTENING DEVICE WITH ACTIVE NOISE CONTROL

(71) Applicant: Apple Inc., Cupertion, CA (US)

(72) Inventors: Esge B. Andersen, Campbell, CA (US); Andre L. Goldstein, San Jose, CA (US)

(73) Assignee: Apple Inc., Cupertino, CA (US)

( * ) Notice: Subject to any disclaimer, the term of this patent is extended or adjusted under 35 U.S.C. 154(b) by 40 days.

(21) Appl. No.: 14/330,904

(22) Filed: Jul. 14, 2014

(65) Prior Publication Data

US 2015/0310846 A1 Oct. 29, 2015

Related U.S. Application Data

(60) Provisional application No. 61/983,065, filed on Apr. 23, 2014.

(51) Int. Cl.

| | |
|---|---|
| ***G10K 11/178*** | (2006.01) |
| ***H04R 1/22*** | (2006.01) |
| ***H04R 3/04*** | (2006.01) |
| ***B05B 7/24*** | (2006.01) |
| ***B05B 7/08*** | (2006.01) |

(52) U.S. Cl.

CPC ..... *B05B 7/2464* (2013.01); *B05B 7/0884* (2013.01); *B05B 7/2429* (2013.01); *B05B 7/2491* (2013.01); *G10K 11/178* (2013.01); *H04R 1/22* (2013.01); *H04R 3/04* (2013.01); *H04R 2410/03* (2013.01)

(58) Field of Classification Search

None

See application file for complete search history.

(56) References Cited

U.S. PATENT DOCUMENTS

| | | | | |
|---|---|---|---|---|
| 8,320,974 | B2 | 11/2012 | Nicholson | |
| 2009/0279709 | A1* | 11/2009 | Asada | G10K 11/178 381/71.1 |
| 2010/0246836 | A1* | 9/2010 | Johnson, Jr. | H04R 29/00 381/58 |
| 2010/0246845 | A1* | 9/2010 | Burge | H04R 1/1041 381/71.6 |
| 2011/0142247 | A1* | 6/2011 | Fellers | G10K 11/178 381/71.1 |
| 2012/0140943 | A1* | 6/2012 | Hendrix | G10K 11/1782 381/71.11 |
| 2012/0207317 | A1* | 8/2012 | Abdollahzadeh Milani | G10K 11/1784 381/71.6 |
| 2012/0207319 | A1* | 8/2012 | Tsuchiya | H03G 9/025 381/74 |
| 2013/0039507 | A1 | 2/2013 | Park et al. | |
| 2013/0287219 | A1 | 10/2013 | Hendrix et al. | |
| 2013/0345842 | A1* | 12/2013 | Karakaya | H04R 5/04 700/94 |
| 2014/0146976 | A1 | 5/2014 | Rundle | |
| 2014/0270208 | A1* | 9/2014 | Miller | H04R 3/005 381/59 |
| 2014/0274198 | A1* | 9/2014 | Miller | H04W 88/02 455/550.1 |
| 2014/0307890 | A1* | 10/2014 | Zhou | H04R 3/002 381/71.11 |
| 2015/0023510 | A1* | 1/2015 | Shimizu | H04R 29/00 381/58 |
| 2015/0161980 | A1* | 6/2015 | Alderson | G10K 11/1784 381/71.11 |

* cited by examiner

*Primary Examiner* — Brenda Bernardi

(74) *Attorney, Agent, or Firm* — Blakely, Sokoloff, Taylor & Zafman LLP

(57) ABSTRACT

In a personal listening device, an ANC system can benefit from a mechanism to detect an off-ear condition, which may be a situation in which the user of the personal listening device has moved an earphone or handset housing away from her ear. A detector may detect such a condition using signals from a touch sensor and/or a vibration sensor that are integrated in the earphone or handset housing, and in response power down the ANC system, or in the case of an adaptive ANC system slow down, or even freeze, the adaptation of one or more adaptive filters. The detector may operate during for example a phone call or during media file playback. Other embodiments are also described.

21 Claims, 3 Drawing Sheets

OFF-EAR DETECTOR FOR PERSONAL LISTENING DEVICE WITH ACTIVE NOISE CONTROL

This non-provisional application claims the benefit of the earlier filing date of provisional application No. 61/983,065 filed Feb. 10, 2014.

An embodiment of the invention relates to personal listening audio devices such as earphones and telephone handsets, and in particular the use of acoustic noise cancellation or active noise control (ANC) to improve the user's listening experience by attenuating external or ambient background noise. Other embodiments are also described.

BACKGROUND

It is often desirable to use personal listening devices when listening to music and other audio material, or when participating in a telephone call, in order to not disturb others that are nearby. When a compact profile is desired, users often elect to use in-ear earphones or headphones, sometimes referred to as earbuds. To provide a form of passive barrier against ambient noise, earphones are often designed to form some level of acoustic seal with the ear of the wearer. In the case of earbuds, silicone or foam tips of different sizes can be used to improve the fit within the ear and also improve passive noise isolation.

With certain types of earphones, such as loose fitting earbuds, as well telephone handsets, there is significant acoustic leakage between the atmosphere or ambient environment and the user's ear canal, past the external surfaces of the earphone or handset housing and into the ear. This acoustic leakage could be due to the loose fitting nature of the earbud housing, which promotes comfort for the user. However, the additional acoustic leakage does not allow for enough passive attenuation of the ambient noise at the user's eardrum. The resulting poor passive acoustic attenuation can lead to lower quality user experience of the desired user audio content, either due to low signal-to-noise ratio or speech intelligibility especially in environments with high ambient or background noise levels. In such a case, an ANC mechanism may be effective to reduce the background noise and thereby improve the user's experience.

ANC is a technique that aims to "cancel" unwanted noise, by introducing an additional, electronically controlled sound field referred to as anti-noise. The anti-noise is electronically designed so as to have the proper pressure amplitude and phase that destructively interferes with the unwanted noise or disturbance. An error sensor (typically an acoustic error microphone) is provided in the earphone housing to detect the so-called residual or error noise. The output of the error microphone is used by a control system to adjust how the anti-noise is produced, so as to reduce the ambient noise that is being heard by the wearer of the earphone. Optionally, a signal from one or more reference microphones are also produced (typically in digital form), for use by an ANC controller. The ANC controller operates while the user is, for example, listening to a digital music file that is stored in a local audio source device, or while the user is conducting a conversation with a far-end user of a communications network in an audio or video phone call, or during another audio application that may be running in the audio source device. The ANC controller implements digital signal processing operations upon the microphone signals so as to produce an anti-noise signal, where the anti-noise signal is then converted into sound by the speaker driver system.

SUMMARY

The implementation of an ANC system in a personal listening device can benefit from a mechanism that automatically detects when the personal listening device is not against the user's ear, during in-the-field or online use of the device, for example when the user has removed a an earphone or handset housing from her ear (also referred to here as off-ear or away from the ear) during playback (without having manually paused or stopped the playback). In such a situation the benefits of the anti-noise being produced by the ANC system may not be perceivable by the user, and so the ANC system in that case is powered down or deactivated (or disabled). An off-ear detector helps achieve such a result. The ANC system may be reactivated when the off-ear detector indicates that the personal listening device is back against the user's ear.

In addition, in the case of an adaptive ANC system, the off-ear detector may be designed to slow down, freeze, halt, or reset to a default setting the adaptation of one or both of the adaptive control filter, e.g. W(z) or G(z), and the S_hat(z) filter, upon deciding that the device is off-ear. This may help reduce the risk of the adaptive filters diverging or converging to a wrong solution, thereby helping conserve computational power and/or battery power (in the case of a portable personal listening device).

Several implementations of the off-ear detector are described. In one embodiment, the detection decision is based solely on using signals from one or more of a touch sensor and a vibration sensor that are integrated in a earphone or handset housing of the device. Examples of such sensors include a capacitive sensor in the housing that can detect the presence and absence of contact between an outside of the housing with the user's skin, and a vibration or inertial sensor such as an accelerometer that can pick up bone conduction vibration that is induced because the user is talking. In another embodiment, while an ANC process is running, the off-ear condition is detected based on a combination of a) processing of the signals from the integrated touch and/or vibration sensors and b) the results of audio signal processing that is automatically performed upon a an ANC-based transfer function estimate and, optionally, a signal from an acoustic microphone that is integrated in the earphone or handset housing. In other embodiments, the detection decision may be based solely upon the audio signal processing scheme which analyzes the secondary transfer function estimate, S_hat(z).

The off-ear detector may operate continuously while an ANC process is running, during for example a phone call or while the user is listening to music. When the user suddenly removes an earphone from her ear or moves a phone handset away from her ear, without manually signaling the end of the call or pausing playback, the detector automatically asserts its control signal (or declares an off-ear event or state) which in turns causes a slow down or freezing/halting of the adaptation one or more adaptive filters used in the ANC process, or causes the deactivation or disabling of the ANC process.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Figure 1:
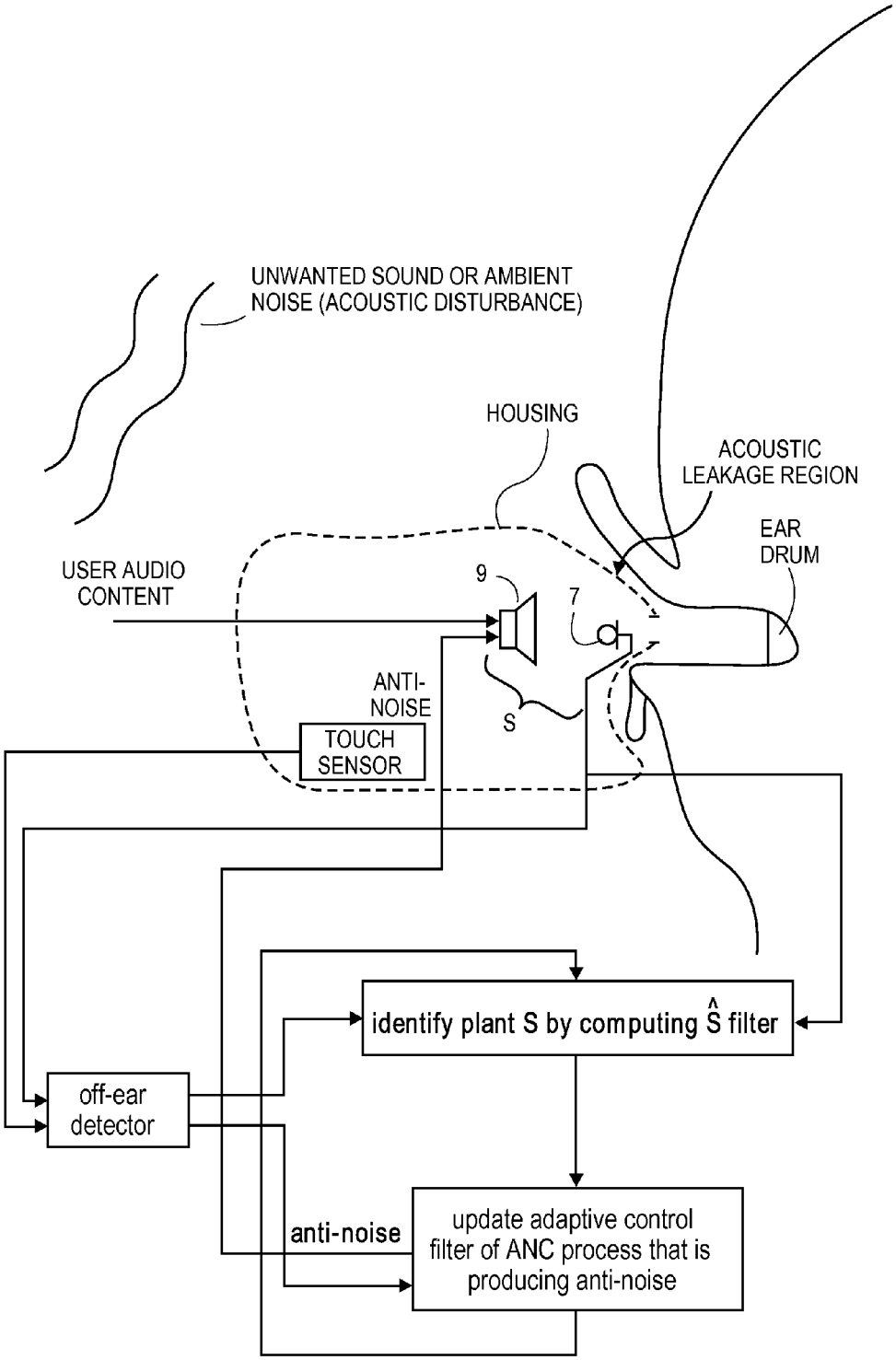
FIG. 1 is a block diagram of part of a consumer electronics personal listening device in which an embodiment of the invention can be implemented.

Several embodiments of the invention with reference to the appended drawings are now explained. Whenever the relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known circuits, structures, and techniques have not been shown in detail so as not to obscure the understanding of this description.

The control filter of an ANC system is designed to process a signal that has been derived from the output of one or more microphones, in order to produce an anti-noise signal that has the required amplitude and phase characteristics for effective cancellation of the disturbance (which is the ambient noise that has leaked into the user's ear canal). In many instances, an error microphone is used, and the control filter is configured based on the assumption that the electroacoustic response between the earphone speaker driver and the error microphone, when the earphone has been placed in or against the ear, can be quantified. This electroacoustic response is often referred to as the "plant" or the "secondary" acoustic path transfer function, S(z). This is in view of a "primary" acoustic path, P(z), that is the path taken by the disturbance in arriving at the user's eardrum.

In a feedback type of ANC system, a signal representing the disturbance as picked up by the error microphone is fed to the control filter, which in turn produces the anti-noise. The control filter in that case is sometimes designated G(z). The control filter G(z) can be adaptively controlled or varied so as to result in an anti-noise that destructively interferes with the disturbance that has arrived at the eardrum through the primary acoustic path. In an ANC system that has a feed forward algorithm, the control filter is sometimes designated W(z). An input signal to the control filter W(z) is derived from the output of a reference microphone, which is located so as to pick up the disturbance before the disturbance has completed its travel through the primary acoustic path. In a hybrid approach, elements of the feed forward and feedback topologies are combined, where the control filter (now referred to simply as W(z)) produces an anti-noise signal based on signals derived from both an output of the reference microphone and an output of the error microphone, where W(z) may be adapted using a signal from the error microphone.

In some applications the frequency response of the overall sound producing system, which includes the electro-acoustic response of the speaker and the physical or acoustic features of the user's ear up to the eardrum, can vary substantially during normal end-user operation, as well as across different users. Thus, it is desirable for improved performance to implement a digital ANC system based on an adaptive filtering scheme, such as the well-known filtered-x least means square algorithm (FXLMS). In such an algorithm, the residual error (as picked up by the error microphone) is used to monitor the performance of the ANC system, while aiming to reduce the error (and hence the ambient noise that is being heard by the user of the earphone or telephone handset). The reference microphone is also used, to help pick up the ambient noise or disturbance. In such algorithms, adaptive identification of the secondary path S(z) is also required. Thus, there are two adaptive filter algorithms operating simultaneously for each channel, namely one that adapts the control filter W(z) or G(z) to produce the anti-noise, and another that adapts an estimate of the secondary path, namely a filter S_hat(z), while user audio content, e.g. downlink or playback signal, or a training audio signal is being converted by the speaker.

FIG. 1 is a block diagram of part of a consumer electronics personal listening device having an ANC system and in which an embodiment of the invention can be implemented. The personal listening device depicted here has a housing in which a speaker driver system 9 is located in addition to an error microphone 7. The housing, also referred to as a speaker housing, is to be held against or inside a user's ear as shown, and a speaker driver system 9 integrated therein. The speaker driver system 9 is to convert an audio signal, which may include user audio content (or perhaps an ANC system training audio signal) and an anti-noise signal, into sound. It should be noted that in some cases, the speaker driver system 9 may have multiple drivers, one or more of which could be dedicated to convert an anti-noise signal, though in most instances there is at least one driver that receives a mix of both the user audio content and the anti-noise within its input audio signal. The sound produced by the driver system 9 will be heard by the user in addition to unwanted sound or ambient noise (also referred to as acoustic disturbance) that manages to leak past the speaker housing and into the user's ear canal. The housing may be, for example, that of a wired or wireless headset, a loose fitting earbud housing, an earpiece speaker portion of the housing of a mobile phone handset, a supra-oral earphone housing, or other type of earphone housing. In the case of an earphone, the user audio content or ANC training audio sweep signal may be delivered through a wired or wireless connection (not shown) from an audio source device such as a smartphone, a tablet computer, or a laptop computer. In all of these instances, there may be a variable acoustic leakage region where the disturbance can leak past the speaker housing and into the ear canal. Although not shown in FIG. 1, in some instances the housing may also include a reference microphone which would be positioned typically at an opposite end or side of the housing as the error microphone 7 and the speaker driver system 9, in order to better pick up the unwanted acoustic disturbance prior to its passing into the ear canal.

In addition, the speaker housing may include a touch sensor integrated therein so as to be able to detect (with the help of other conventional hardware or software—not shown) when the outside of the housing touches the user's skin, such as when the user has inserted an earphone into her ear canal, or is holding a phone handset against her ear. Examples of the touch sensor include a capacitive sensor and a resistive touch sensor. As an alternative to the touch sensor, or perhaps in addition thereto, the speaker housing may include an infrared-based proximity sensor to detect when the housing is close to though not necessarily touching a nearby object such as the user's ear.

In an adaptive ANC process operating upon a personal listening device such as a earphone or a phone handset, the adaptation of the filters such as W(z) and Ŝ(z) may become unstable or may converge to an incorrect solution, when the housing comes off the ear. In accordance with an embodiment of the invention, an off-ear detector is provided that makes a decision to slow down or freeze the filter adaptation in that case, or to even disable or inactivate the ANC process (so as to further reduce power consumption and free up computing resources) when it detects an off ear condition or event. This helps avoids having the ANC system become unstable.

In one embodiment, the off ear detector comprises circuitry and/or software (being executed by a processor) that process a digital signal from the touch sensor to resolve or translate the sensed data into one of at least two discrete states, namely an on-ear (or in-ear) state and an off-ear state. Any suitable capacitive sensing technique for example can be used, for the off-ear detection function.

There are times however when using a touch sensor, such one that performs capacitive sensing, to provide off-ear detection, is unreliable. For example, when the user is holding an earphone (which contains a touch sensor) in her hand, and has not placed the earphone into or against her ear yet, the touch sensor-based data processing will indicate that the earphone housing is in contact with the user's skin; in this situation, one cannot rely solely on the touch sensor data to declare an off-ear condition. To improve reliability of detection of the off-ear condition, an embodiment of the invention takes advantage of certain digital ANC parameters that are inherently available while an ANC process is running in the person listening device, and computes a further measure or metric that can inform the decision to declare an off-ear condition. Such processing of the ANC parameter may be as follows.

Figure 2:
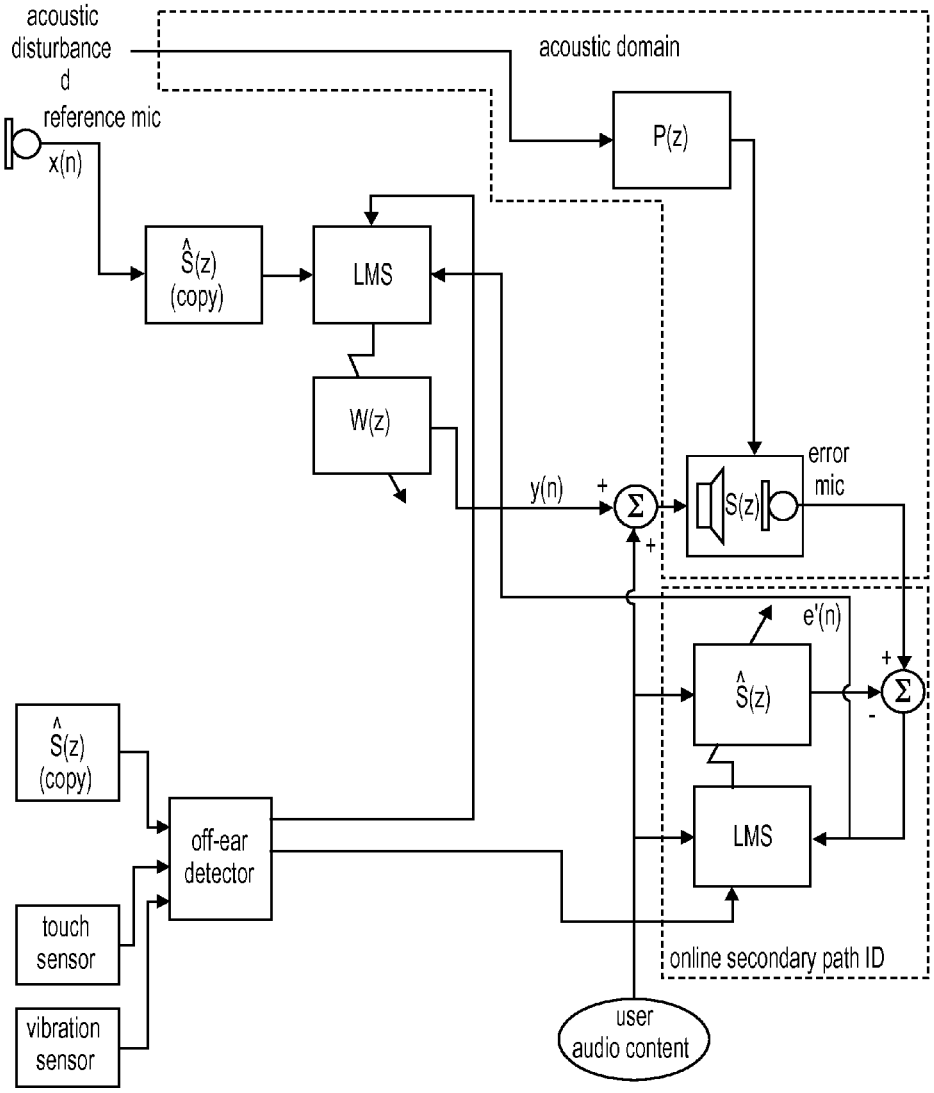
FIG. 2 is a block diagram of a personal listening device implementing another off-ear detection technique that may be used to improve adaptive ANC.

As mentioned above, an ANC controller or ANC process may implement a feed forward, feedback, or a hybrid adaptive noise control algorithm. The ANC controller adapts the coefficients of a control filter, e.g. W(z) or G(z), according to an adaptive algorithm, e.g. filtered-x LMS. In some instances of these algorithms, there are also digital processing blocks that identify the plant S, or the secondary path acoustic transfer function S(z) which, as depicted in FIG. 1, refers to the path from an input of the speaker driver system 9 to an output of the error microphone 7. The plant S, or transfer function S(z), may be identified using any suitable technique in which it is estimated, by computing what is referred to as an S_hat(z) filter, or filter Ŝ(z), which estimates at least the magnitude response of the plant S. FIG. 2 shows an embodiment where the S_hat(z) filter is also adaptive, where another adaptive filter controller adapts the coefficients of a digital filter Ŝ(z), e.g. a finite impulse response, FIR, filter, using an adaptive algorithm (e.g., LMS). In other words, the S_hat(z) is automatically and continually being updated during in-the-field use of the personal listening device.

In accordance with an embodiment of the invention, the off-ear detector uses the information that is in the S_hat(z) filter, to inform its decision as to whether or not an off-ear condition is detected. The resulting S_hat(z) filter-based detection metric may be used in conjunction with another off-ear metric that is derived from the touch sensor's data (and/or from a proximity sensor). The S_hat(z) filter-based detection metric could alternatively be used by itself, to indicate an off-ear declaration (while ANC is active).

Figure 3:
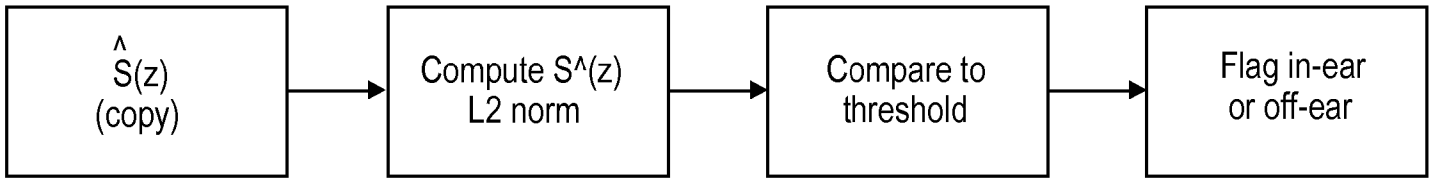
FIG. 3 depicts a block diagram of an off-ear detector that relies at least in part upon processing of the S_hat filter for making its off-ear and/or on-ear (or in-ear) condition decisions.

In one embodiment, referring now to FIG. 3, an L2 norm of the coefficients of the digital filter S_hat(z) is computed, as the S_hat(z) filter-based detection metric. The computed L2 norm may then be compared to a preset (fixed or variable) threshold, and then the off-ear event may be declared if the S_hat(z)-based detection metric is greater than the threshold. In one embodiment, this process of analyzing the S_hat(z) filter continually repeats during an audio application, for example during a file playback or during a phone call, so as to update the S_hat filter based detection metric which is then used to inform the off-ear decision.

Figure 4:
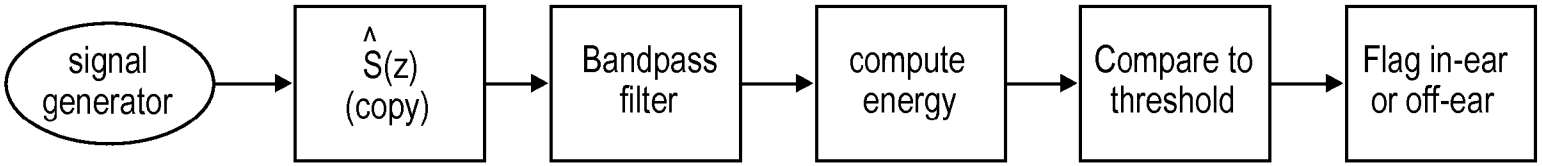
FIG. 4 depicts a block diagram of another S_hat filter based off-ear detector.

FIG. 4 shows another technique for computing the S_hat (z) detection metric, where S_hat(z) is analyzed in the frequency domain, and the energy in or more frequency bands are computed (where this process also repeats over time during file playback or during a phone call). In the particular example shown, a copy of the S_hat filter is stimulated using a known signal (e.g., white noise) and its output is converted into frequency domain and bandpass filtered so as to isolate one or more frequency bins of interest. Strength of the desired frequency band is computed, e.g. an energy computation or an RMS power computation, as the S_hat(z)-based detection metric of interest. The latter is then compared to a threshold. Since energy content, especially at low audio frequencies for example below 1 kHz, decreases significantly as the housing is removed from the ear, a threshold can be established such that when the computed energy falls below that threshold, an off-ear condition may be declared.

With respect to slowing down the adaption process which is continually updating a digital control filter W(z) or G(z), when an off-ear condition has been declared, adaption may be slowed down by for example reducing the step size parameter of a gradient descent adaptive filter algorithm. This may be done while maintaining the same sampling rate for the digital microphone signals, and perhaps also maintaining the sampling rate of the digital touch or vibration sensor signals. Alternatively, or in addition, the update interval for actually updating the coefficients of the adaptive filter can be changed, for example from 20 microseconds to several milliseconds. Of course, the adaptation may alternatively be frozen in that the coefficients of the digital adaptive filters are kept essentially unchanged, upon the occurrence of the off-ear condition. The adaptive filters then are allowed to be updated once the off-ear event is deemed to be over, e.g. an on-ear (or in-ear) event has been declared. In one embodiment, the adaptive filter algorithm for the control filter W(z) or G(z) may be allowed to continue to run during a holding interval immediately following the declaration of an off-ear event, i.e. it continues to produce new digital filter coefficient lists that define the control filter, though the adaptive filter is not actually being updated with these coefficient lists.

Referring back to FIG. 2, this figure shows a filtered-x LMS feed forward adaptive algorithm for computing W(z). An online secondary path identification block adapts the coefficients of the filter Ŝ(z) in an attempt to match the response of the control plant S. The identification can be performed while the anti-noise signal is combined with user audio content from a media player or telephony device, or with a predefined audio identification noise or audio sweep signal (not shown). The control filter W(z) is adapted according to the filtered-x LMS algorithm that adapts using the reference signal x(n) filtered by a copy of S_hat(z) and the residual error signal e'(n). The disturbance in this case may be any ambient noise, or it may be an electronically controlled disturbance signal (test or training signal) produced by a nearby loudspeaker (not shown).

In the case of a feed forward algorithm such as the one shown in FIG. 2, the anti-noise signal y(n) is generated by filter W(z) and is combined with the user audio content to drive the speaker system 9. In contrast, in a feedback algorithm (not shown), the anti-noise y(n) is generated by a variable filter G(z) whose input is driven by a signal derived from the residual error signal e'(n) (coming from the error microphone 7). In yet another embodiment, namely a hybrid approach, y(n) is produced based on the outputs of both a W(z) filter and a G(z) filter. The off-ear detectors described here may be used in any one of these adaptive embodiments, to slow down or freeze the adaptation of one or more of the adaptive or variable control filters W(z), G(z).

To summarize, as an alternative to using a touch sensor to detect the away-from-the-ear condition, FIG. 2 shows the use of a vibration sensor such as a multi-axis accelerometer to further inform the off-ear decision. As depicted in that figure, in yet another embodiment, the digital signals from the touch sensor and the vibration sensor can be processed in a combined fashion to further inform the off-ear decision, to help reduce the incidence of false positives for example. A further source of useful information that may be combined to render a group-based off-ear decision is the information contained in the S_hat(z) filter, as described above.

The off-ear detector described above may also be designed to detect an on-ear condition, i.e. a condition where the earphone or handset housing is being held up against (in contact with) the ear or within the ear canal of its user. The same digital signals from the touch sensor and/or vibration sensor that are used to detect the off-ear condition can also be used here to detect the on-ear condition, except that here the comparisons which are performed upon the sensor data will be in the opposite direction, and the threshold used in such comparisons may also be different, e.g. when applying hysteresis in transitioning from the off-ear declaration to the on-ear declaration. To assist in the decision that declares the on-ear condition, the audio signal processing techniques described above that are based on a copy of the adaptive S_hat filter can also be used (provided of course that the ANC process is running)—see FIG. 3 and FIG. 4 where the comparison operation can yield either an in-ear flag or an off-ear flag depending on the particular threshold used and the direction of the comparison. In one embodiment, while the ANC process is active and an on-ear condition has been declared, the ANC controller can speed up or unfreeze its continuing adaptation of the adaptive control filter. In another embodiment, while the ANC process is inactive and an on-ear condition is declared (based only on the vibration and/or touch sensor data, since the S_hat filter information may not be available or valid while ANC is inactive), the ANC controller or process may be activated in response.

As described above, an embodiment of the invention may be implemented as a machine-readable medium (such as microelectronic memory) having stored thereon instructions, which program one or more data processing components (generically referred to here as a "processor") to perform the digital signal processing operations described above including touch sensor or vibration sensor data processing, S_hat filter computation, signal strength measurement, filtering, mixing, adding, inversion, comparisons, and decision making, for example. In other embodiments, some of these operations might be performed by specific hardware components that contain hardwired logic (e.g., dedicated digital filter blocks). Those operations might alternatively be performed by any combination of programmed data processing components and fixed hardwired circuit components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, although some numerical values have been given above, these are only examples used to illustrate some practical instances; they should be not used to limit the scope of the invention. In addition, other cross correlation techniques for computing the detection statistic may be used. The description here in general is to be regarded as illustrative instead of limiting.

The invention claimed is:

1. A method for acoustic noise cancellation (ANC) in a personal listening device, comprising:

performing an acoustic noise cancellation (ANC) process during in-the-field use of the personal listening device using an adaptive control filter to produce anti-noise by the personal listening device, the ANC process computing an adaptive path filter in accordance with an adaptive filter control algorithm, the adaptive path filter estimating a transfer function of a signal path between an earpiece speaker of the personal listening device and an error microphone that are configured to be located at a user's ear;

making a first copy of the adaptive path filter;

detecting an off-ear condition using an adaptive path filter-based detection metric determined from information that is in the first copy of the adaptive path filter; and one of a) slowing down or freezing adaptation of the adaptive control filter, or b) disabling the ANC process so as to power down the ANC process, in response to the off-ear condition being detected.

2. The method of claim 1 wherein detecting the off-ear condition comprises analyzing the first copy of the adaptive path filter in a frequency domain by comparing a strength of a frequency band to a threshold.

3. The method of claim 2 wherein analyzing the first copy of the adaptive path filter comprises:

bandpass filtering a response of the first copy of the adaptive path filter while stimulating the first copy of the adaptive path filter with a known signal;

computing a strength of the bandpass filtered response; and comparing the strength of the bandpass filtered response to a threshold.

4. The method of claim 2 wherein analyzing the first copy of the adaptive path filter comprises computing an L2 norm of the first copy of the adaptive path filter and comparing the L2 norm to a threshold.

5. The method of claim 1 further comprising:

detecting an on-ear condition using one or more signals of a touch sensor and a vibration sensor; and one of a) speeding up or unfreezing adaptation of the adaptive control filter, or b) activating the ANC process, in response to the on-ear condition being detected.

6. The method of claim 1 further comprising making a second copy of the adaptive path filter and filtering a reference microphone signal with the second copy of the adaptive path filter to produce a filtered reference microphone signal that is provided to an adaptive controller which is controlling a filter that produces an anti-noise signal.

7. The method of claim 1 wherein the adaptive path filter is an adaptive S_hat filter and the first copy of the adaptive path filter is a copy of the adaptive S_hat filter.

8. A personal listening device comprising:

an earpiece speaker that is configured to be located at a user's ear;

an error microphone that is configured to be located at the user's ear;

an acoustic noise cancellation (ANC) controller having an adaptive filter control engine that updates an adaptive control filter which produces an anti-noise signal when an ANC process is running, the ANC process computing an adaptive path filter in accordance with an adaptive filter control algorithm, the adaptive path filter estimating a transfer function of a signal path between the earpiece speaker and the error microphone, and making a first copy of the adaptive path filter; and an off-ear detector that uses an adaptive path filter-based detection metric determined from information that is in the first copy of the adaptive path filter, to declare an off-ear condition for the personal listening device, wherein the ANC controller responds to the declared off-ear condition by one of a) slowing down or freezing the updating of the adaptive control filter, or b) becoming deactivated so as to save power.

9. The personal listening device of claim 8 wherein the off-ear detector analyzes a signal from a touch sensor or a vibration sensor that is integrated in an earphone or a handset housing of the personal listening device, in addition to analyzing a signal from the first copy of the adaptive path filter, to inform its decision to declare the off-ear condition.

10. The personal listening device of claim 8 wherein the off-ear detector analyzes the first copy of the adaptive path filter in a frequency domain by comparing a strength of a frequency band to a threshold.

11. The personal listening device of claim 10 wherein the off-ear detector analyzes the first copy of the adaptive path filter by computing an L2 norm of the first copy of the adaptive path filter and comparing the L2 norm to a threshold.

12. The personal listening device of claim 10 wherein the off-ear detector analyzes the first copy of the adaptive path filter by bandpass filtering a response of the first copy of the adaptive path filter while stimulating the first copy of the adaptive path filter with a known signal, computing a strength of the bandpass filtered response, and comparing the strength of the bandpass filtered response to a threshold.

13. The personal listening device of claim 8 wherein the adaptive path filter is an adaptive S_hat filter and the first copy of the adaptive path filter is a copy of the adaptive S_hat filter.

14. A personal listening device comprising:

an earpiece speaker that is configured to be located at a user's ear;

an error microphone that is configured to be located at the user's ear;

an acoustic noise cancellation (ANC) controller having an adaptive filter control engine that updates an adaptive control filter which produces an anti-noise signal when an ANC process is running, the ANC process computing an adaptive path filter in accordance with an adaptive filter control algorithm, the adaptive path filter estimating a transfer function of a signal path between the earpiece speaker and the error microphone, and making a first copy of the adaptive path filter; and an on-ear detector that uses an adaptive path filter-based detection metric determined from information that is in the first copy of the adaptive path filter, to declare an on-ear condition for the personal listening device, wherein the ANC controller responds to the declared on-ear condition by one of a) speeding up or unfreezing the updating of the adaptive control filter, when the ANC process is running, or b) activating the ANC process, when the ANC process is not running.

15. The personal listening device of claim 14 wherein the on-ear detector analyzes a signal from a touch sensor or a vibration sensor that is integrated in an earphone or a handset housing of the personal listening device, in addition to analyzing a signal from the first copy of the adaptive path filter, to inform its decision to declare the on-ear condition.

16. The personal listening device of claim 15 wherein while the ANC process is running and the on-ear condition has been declared, the ANC controller is to speed up or unfreeze its continuing adaptation of the adaptive control filter, and while the ANC process is inactive and the on-ear condition is declared based on analyzing the signal from the vibration sensor and/or the touch sensor, the ANC controller is activated in response.

17. The personal listening device of claim 14 wherein the on-ear detector uses the adaptive path filter-based detection metric to declare the on-ear condition for the personal listening device by analyzing the first copy of the adaptive path filter in a frequency domain by comparing a strength of a frequency band to a threshold.

18. The personal listening device of claim 17 wherein analyzing the first copy of the adaptive path filter comprises:

bandpass filtering a response of the first copy of the adaptive path filter while stimulating the first copy of the adaptive path filter with a known signal;

computing a strength of the bandpass filtered response; and comparing the strength of the bandpass filtered response to a threshold.

19. The personal listening device of claim 17 wherein analyzing the first copy of the adaptive path filter comprises computing an L2 norm of the first copy of the adaptive path filter and comparing the L2 norm to a threshold.

20. The personal listening device of claim 14 wherein the ANC process further makes a second copy of the adaptive path filter and filters a reference microphone signal with the second copy of the adaptive path filter to produce a filtered reference microphone signal that is provided to an adaptive controller which is controlling a filter that produces an anti-noise signal.

21. The personal listening device of claim 14 wherein the adaptive path filter is an adaptive S_hat filter and the first copy of the adaptive path filter is a copy of the adaptive S_hat filter.

* * * * *